United States Patent [19]

Muhlethaler

[11] 4,176,742

[45] Dec. 4, 1979

[54] MATCH CARRIER INCLUDING FRANGIBLE PROTRUSIONS

[75] Inventor: Henri Mühlethaler, Yverdon, Switzerland

[73] Assignee: Henri Mühlethaler S.A., Vaud, Switzerland

[21] Appl. No.: 895,745

[22] Filed: Apr. 13, 1978

[30] Foreign Application Priority Data

Apr. 21, 1977 [CH] Switzerland ..... 4933/77

[51] Int. Cl.[2] ..... A24F 27/20

[52] U.S. Cl. ..... 206/98; 206/134

[58] Field of Search ..... 206/86, 94, 98-101, 206/96, 134

[56] References Cited

U.S. PATENT DOCUMENTS

| | | | |
|---|---|---|---|
| 872,243 | 11/1907 | Luna | 206/98 |
| 1,873,420 | 8/1932 | Jorgensen | 206/100 |
| 2,139,036 | 12/1938 | Pullen | 206/98 |
| 2,405,865 | 8/1946 | Watkins | 206/98 |
| 2,787,370 | 4/1957 | Olsen | 206/99 |
| 3,176,835 | 4/1965 | Marach | 206/96 |
| 3,509,989 | 5/1970 | Woll | 206/100 X |

FOREIGN PATENT DOCUMENTS

| | | | |
|---|---|---|---|
| 2021717 | 11/1971 | Fed. Rep. of Germany | 206/100 |

*Primary Examiner*—Stephen Marcus

*Attorney, Agent, or Firm*—Silverman, Cass & Singer, Ltd.

[57] ABSTRACT

A matches-carrier including a support for the matches arranged in rows thereon and a friction-strip carried on the support. The support includes resilient bearing means arranged to bear on the matches and press the same against the friction-strip. Withdrawal of a match from the support causes the match to slip against the friction-strip to kindle the same.

6 Claims, 3 Drawing Figures

MATCH CARRIER INCLUDING FRANGIBLE PROTRUSIONS

BACKGROUND OF THE INVENTION

The present invention relates to a match carrier.

The match carrier disclosed is characterized by a support for receipt of matches arranged in rows thereon and at least a friction-strip carried by the said support. Resilient bearing means, also carried by the said support, are arranged to bear on the matches so that, when a match is withdrawn from the support, the match head slips on the friction-strip against which the match is forced by the bearing member, and thereby kindle the match.

BRIEF DESCRIPTION OF THE DRAWING

The drawing shows, by way of example, one embodiment constructed in accordance with the invention.

DESCRIPTION OF THE PREFERRED EMBODIMENT

Figure 2:
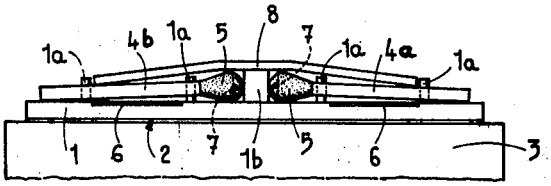
FIG. 2 is an enlarged sectional view of the match carrier of FIG. 1 taken in the direction of arrow II and FIG. 3 is an enlarged plan view of said match carrier with a portion of the carrier being removed.

The match carrier represented comprises a support constituted by a rectangular plate 1 provided, on its rear face, with an auto-adhesive coating 2 (FIG. 2) permitting securement of the carrier on a cigarette box 3. The plate 1, formed preferably of plastic material, is provided with four rows of pins 1*a* between which are placed the matches 4, arranged in ear way. The distance between the pins 1*a* is such that the stems of the matches are arranged between said pins without play, while, when a longitudinal traction is force exerted on the matches, their inflamable heads 5 are be retained by the pins 1*a* between which they can not pass.

The support 1 carries two chemical friction-strips each situated between two rows of pins 1*a*.

The plate 1 is provided with a central rib 1*b*, coinciding with its great axis, the longitudinal lateral faces of which are provided with alveoles 7, having an arc of circle shaped wall, in each of which is partially engaged the head 5 of a match. One of the ends of the plate 1 is provided with a thickened portion 1*c*.

The match carrier comprises moreover a bearing plate 8, formed of plastic material, of rectangular shape, the great axis of which coincides with the great axis of the plate 1, and which is welded on the central rib 1*b* of plate 1. The plate is cambered and bears, by its two opposed longitudinal edges, on the stems of the matches 4, opposite the friction-strips 6.

Figure 1:
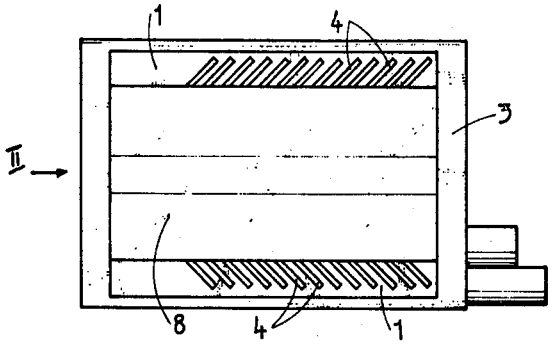
FIG. 1 is a plan view of a match carrier secured to a cigarette box.

When the matches are arranged in ear way on the plate 1, they do not extend beyond the edges of the plate. On the other hand, the matches extend beyond the edges of the bearing plate 8, the width of which is less than the width of the plate 1; thus, the end of each match extending beyond the bearing plate 8 is thereby rendered accessible. The user grips one or the other of the two matches positioned at the base of the ear, i.e. the matches 4*a* and 4*b* of FIGS. 1 and 3, and exerts thereon a folding back movement in the direction of arrows 9, respectively 10, respectively of FIG. 3. Such movement will break the pins 1*a* which the stem of the folded back match encounters when moving. During this movement, the head 5 of the match rotates in the corresponding alveole 7, as a bowling joint.

Figure 3:
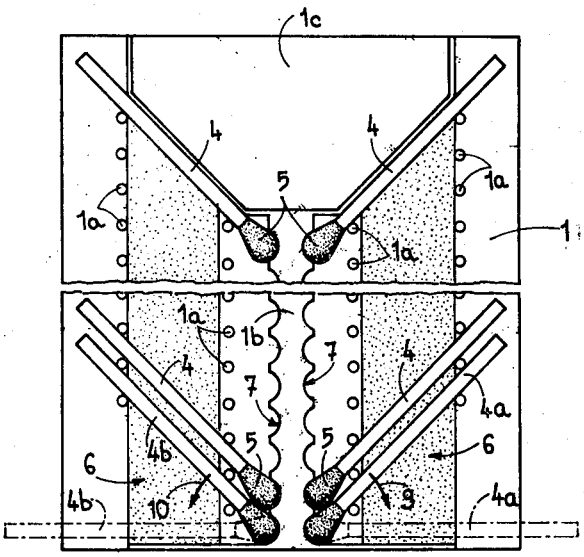

Once the match 4*a* or 4*b* is brought into the position represented in dot-and-dash lines in FIG. 3, in which the match is perpendicular to the longitudinal edge of the support 1, the end of the match extends beyond said longitudinal edge to permit the user to obtain a better grip on the match for exerting thereon a traction force. Exerting said force comes the match to slip between the support 1 and the bearing plate 8 which presses the head 5 of the match against the friction-strip 6 opposite to which it moves. This latter action produces automatically kindling of the match thus extracted from the match carrier.

Due to the very low cost of the said match carrier, entirely made entirely of plastic material except for the friction-strips 6, constituted by bands sticked on the support 1 or by chemical material directly deposited on the support, the present match carrier is intended to be disposed to waste after use.

What I claim is:

1. A match carrier comprising, a support of generally quadrangular plate configuration having a central rib extending along one axis of said support, said rib having two longitudinal lateral faces defining a plurality of alveoles with walls of generally arc-shaped configuration, a plurality of matches arranged in ear way rows upon said support and not extend beyond the edges of said support, a friction-strip carried by said support, a resilient bearing member of generally quadrangular plate configuration secured along its middle portion to said central rib and bearing along two opposed edges thereof on said matches, the axis of said bearing member being aligned with the axis of said support, said matches having ends which extend beyond said two opposed edges of said bearing member and having heads opposite said ends with said heads being partially engaged in said alveoles, whereby exertion of a force on the end of a selected match rotates the match head in ball-joint fashion in its corresponding alveole to move said selected match into a disposition which is perpendicular to an adjacent edge of said support with the end of said selected match extending beyond said edge to permit exertion of a traction force on said selected match to cause said match head to slip on said friction-strip against which it is applied by said bearing member and thereby kindle said selected match.

2. A match carrier as claimed in claim 1 in which the support has a face on which the matches are arranged, the face including a plurality of protrusions, said matches being disposed between said protrusions to maintain the matches in supported position upon the support.

3. A match carrier as claimed in claim 2 in which said matches have stem parts, said protrusions being arranged such that said stem parts are engaged precisely between said protrusions with the distance between the protrusions being such that a match head cannot pass between adjacent protrusions unless at least one protrusion is broken.

4. A match carrier as claimed in claim 1 including two friction-strips carried by the support, each said friction-strip being positioned opposite a respective opposite edge of the bearing plate.

5. A match carrier as claimed in claim 1 in which the support includes adhesive on a rear face thereof to permit securement thereof to a cigarette box.

6. A match carrier comprising, a support having a face, said face including a plurality of protrusions and a central rib extending along one axis of said support, said central rib having two longitudinal lateral faces defining a plurality of alveoles having walls of generally arc-shaped configuration, said support and protrusions being formed of plastic material, a plurality of matches arranged in rows upon said support face and disposed between said protrusions to maintain said matches in supported position upon said support, said matches including heads on one end thereof, said match heads being partially engaged in said alveoles, a friction-strip carried by said support, a resilient bearing member secured to said central rib along a middle portion of said bearing member and arranged to bear on said matches, whereby exertion of a force on a selected match will move the selected match against an adjacent protrusion to break said protrusion against said force of said moving match and release said match, and will rotate the head of said match in ball-joint fashion in its corresponding alveole and thereafter exertion of a traction force on said selected match will cause said head of said match to slip on said friction-strip against which it is applied by said bearing member and thereby kindle said match.

* * * * *